US007137791B2

(12) United States Patent
Manke et al.

(10) Patent No.: US 7,137,791 B2
(45) Date of Patent: Nov. 21, 2006

(54) AXIAL BEARING ARRANGEMENT FOR A HERMETIC COMPRESSOR

(75) Inventors: Adilson Luiz Manke, Joinville (BR); Dietmar E. Lilie, Joinville (BR)

(73) Assignee: Empresa Brasileira de Compressores S.A., Embraco Joinville (BR)

( * ) Notice: Subject to any disclaimer, the term of this patent is extended or adjusted under 35 U.S.C. 154(b) by 172 days.

(21) Appl. No.: 10/488,560

(22) PCT Filed: Aug. 29, 2002

(86) PCT No.: PCT/BR02/00121

§ 371 (c)(1),
(2), (4) Date: May 3, 2004

(87) PCT Pub. No.: WO03/019008

PCT Pub. Date: Mar. 6, 2003

(65) Prior Publication Data

US 2005/0008502 A1 Jan. 13, 2005

(30) Foreign Application Priority Data

Aug. 31, 2001 (BR) ..... 0105159

(51) Int. Cl.
*F04B 17/00* (2006.01)

(52) U.S. Cl. ..... 417/415; 417/372

(58) Field of Classification Search ..... 417/415; 184/6.5, 6.6; 384/609, 617; 92/72, 140; 74/603, 606, 609, 617
See application file for complete search history.

(56) References Cited

U.S. PATENT DOCUMENTS

| | | | | |
|---|---|---|---|---|
| 3,606,594 | A * | 9/1971 | Smith | 417/415 |
| 4,647,228 | A * | 3/1987 | Jensen et al. | 384/420 |
| 4,718,830 | A | 1/1988 | Middleton et al. | |
| 5,052,825 | A * | 10/1991 | Battig | 384/223 |
| 6,838,788 | B1 * | 1/2005 | Park et al. | 310/12 |
| 2005/0089416 | A1 * | 4/2005 | Lee | 417/415 |

FOREIGN PATENT DOCUMENTS

| | | | |
|---|---|---|---|
| WO | WO 9425768 | A1 * | 11/1994 |
| WO | WO-97/34088 | A1 | 9/1997 |

* cited by examiner

*Primary Examiner*—Anthony Stashick
*Assistant Examiner*—Vikansha Dwivedi
(74) *Attorney, Agent, or Firm*—Darby & Darby

(57) ABSTRACT

A reciprocating hermetic compressor includes a cylinder block internal to a shell and carrying a cylinder and a radial bearing hub; a crankshaft vertically mounted in the radial bearing hub and carrying, inferiorly, a rotor of an electric motor and, superiorly, a support annular face and an eccentric portion. The radial bearing hub incorporates an upper tubular extension, bearing a corresponding extension of the crankshaft and around which is mounted an axial rolling bearing for supporting the weight of the crankshaft-rotor assembly, as well as the axial stresses produced during compression of the refrigerant gas.

17 Claims, 6 Drawing Sheets

AXIAL BEARING ARRANGEMENT FOR A HERMETIC COMPRESSOR

This is a U.S. national phase application under 35 U.S.C. §371 of International Patent Application No. PCT/BR2002/00121 filed Aug. 29, 2002 and claims the benefit of Brazilian Application No. PI 0105159-8 filed Aug. 31, 2001. The International Application was published in English on Mar. 6, 2003 as International Publication No. WO/2003/019008 under PCT Article 21(2). Both applications are incorporated herein by reference.

FIELD OF THE INVENTION

The present invention refers to an axial rolling bearing arrangement for a reciprocating hermetic compressor with a vertical axis, of the type used in small refrigeration systems.

BACKGROUND OF THE INVENTION

Hermetic compressors of refrigeration present, mounted inside a hermetically sealed shell, a cylinder block sustaining a vertical crankshaft, to which is mounted the rotor of an electric motor. The weight of the crankshaft-rotor assembly is supported by an axial bearing generally in the form of a flat axial sliding bearing.

The crankshaft carries, at its lower end, a pump rotor that, during operation of the compressor, conducts lubricant oil from a reservoir defined in the lower portion of the shell to the parts with mutual relative movement, in order to guarantee oil supply for the adequate operation of said parts.

The position of the axial bearing may vary according to the arrangement of the compressor components and to design variations. The solutions consider mounting the rotor to the crankshaft below the cylinder block, such as illustrated in FIG. 1, or mounting the rotor to the crankshaft above the cylinder block, such as illustrated in FIG. 2. Depending on the mounting position of the rotor in relation to the cylinder block, the surfaces that define the axial bearing are altered.

In the situation in which the rotor is mounted below the cylinder block, the lower surface of an annular flange of the crankshaft is axially borne on an annular surface defined at the upper end of the radial bearing hub. On the other hand, when the rotor is mounted above the cylinder block, the lower face of the rotor is axially borne on an annular surface defined at the upper end of the radial bearing hub. However, when the rotor is mounted below the cylinder block, the lower surface of an annular flange of the crankshaft is axially borne on an annular surface defined at the upper end of the radial bearing hub.

In the compressors in which the rotor is mounted below the cylinder block, it is also known the arrangement in which a second bearing is provided radially actuating on the crankshaft, above the eccentric portion of the latter. In this construction, the crankshaft incorporates a second annular flange, whose lower face is axially borne on an upper annular surface of this second radial bearing.

In any of the above-mentioned embodiments, the perfect parallelism between the mutually confronting surfaces that define the axial bearing is not assured, due to the presence of position errors (axial strikes) and mainly to deformations of the components during the operation of the compressor.

The position errors of the surfaces that define the axial bearing can be minimized by using more precise manufacturing processes. However, the deformations of the components are inherent to the operation of the compressor and they are produced during the compression period of the refrigerant gases. These deformations are translated into loss of parallelism between the mutually confronting surfaces that define the axial bearing, resulting in a geometry that is unfavorable to the formation of an oil film, consequently reducing the capacity of sustaining the axial bearing, increasing the mechanical losses by friction and probably causing wear to the surfaces. In addition, the deformation of the components, more specifically the loss of perpendicularity that occurs between the connecting rod and the crankshaft, causes decomposition of the forces that compress the gases, giving origin to a component in the axial direction of the crankshaft, introducing an additional load to the force (weight) of the crankshaft-rotor assembly over the axial bearing.

The improvement in the energetic performance of these compressors can be obtained with the reduction of the mechanical friction losses, by using more efficient bearings. Within this concept, the use of an axial rolling bearing has been proposed, whose operation, in terms of dissipated mechanical loss, presents rates that are close to the ideal. A constructive solution of a bearing using this concept is described in the Brazilian patent PI 8503054 assigned to White Consolidated Industries, Inc. and regarding hermetic compressors in which the rotor of the electric motor is mounted above the cylinder block.

In this type of construction proposed in patent PI 8503054, the axial rolling bearing, which is composed by two annular flat races and by the ball cage, is provided between the rotor face and the annular surface defined at the upper end of the radial bearing hub, with the rolling bearing being guided, in the internal diameter thereof, directly by the external surface of the main body of the crankshaft.

The life of the axial rolling bearings is strongly influenced by the alignment of their races. Nevertheless, the existence of deviations, even of decimals of milliradians in the parallelism between the races, is sufficient to reduce their operational useful life in more than 20 times, as compared with the useful life of an axial rolling bearing with perfectly parallel races. This reduction in the useful life of the rolling bearings occurs due to the concentration of the axial load over one or two balls, instead of this load being distributed over all the balls of the rolling bearing.

In the hermetic compressors having the rotor of the electric motor mounted to the crankshaft below the cylinder block, the simple provision of an axial rolling bearing, such as suggested in patent PI 8503054, between the lower surface of an annular flange of the crankshaft and the annular surface defined at the upper end of the radial bearing hub, will increase the distance between the cylinder axis and said bearing annular surface that constitutes the adjacent end of the radial bearing block, as illustrated in FIG. 3. In this hypothetical mounting condition based on the prior art teachings considered herein, the increase of the distance between the cylinder axis and the adjacent end of the radial bearing hub will tend to cause a greater momentum on the radial bearing hub-crankshaft assembly, consequently increasing the bending and stresses that are applied to this assembly.

Another disadvantage of the embodiment illustrated in FIG. 3 refers to the high oil leakage that occurs throughout the axial rolling bearing, increasing the mechanical losses by viscous friction of the axial rolling bearing and reducing the amount of lubricant oil available in the crankshaft portion and in the components of the compressor mechanism located above the axial rolling bearing. The correct amount of lubricant oil available to the axial rolling bearing allows optimizing the mechanical losses and the useful life of this component.

The increase of the bending of the radial bearing hub-crankshaft assembly and the increase of the leakage throughout the axial rolling bearing increase the noise in the compressor, reduce the energetic efficiency of the bearings and reduce the mechanical reliability of the several compressor components, one of them being the axial rolling bearing.

SUMMARY OF THE INVENTION

It is a general object of the present invention to provide a bearing arrangement for a reciprocating hermetic compressor of refrigeration, without causing parallelism deviation between the mutually confronting surfaces that define the axial bearing.

It is also an object of the present invention to provide a bearing arrangement of the type mentioned above for a reciprocating hermetic compressor of refrigeration, which presents the rotor of the electric motor attached to the vertical crankshaft below the cylinder block, without increasing the bending and stresses over the radial bearing hub-crankshaft assembly.

It is a further object of the present invention to provide a bearing arrangement as mentioned above, which does not impair the adequate lubrication of the crankshaft portion and of the other components of the compressor mechanism located above the axial rolling bearing, and which further allows to define the adequate amount of lubricant oil to be supplied to the axial rolling bearing.

The bearing arrangement in question is applied to a reciprocating hermetic compressor comprising a shell; a cylinder block mounted inside the shell and carrying a cylinder and a vertically disposed radial bearing hub; a vertical crankshaft mounted through the radial bearing hub and having a lower end portion downwardly projecting below the radial bearing hub and affixing the rotor of an electric motor, and an upper end portion upwardly projecting above the radial bearing hub and incorporating a peripheral flange, whose lower face defines a support annular surface and an eccentric portion.

According to the invention, the radial bearing hub incorporates an upper tubular extension that has an internal face radially bearing a corresponding extension of the crankshaft, an annular end face and an external face, concentric to the internal face, around which is mounted an axial rolling bearing. The axial rolling bearing is simultaneously seated on the radial bearing hub and on the support annular surface of the crankshaft, in order to maintain a certain minimal axial gap between said support annular surface and the annular end face of the upper tubular extension.

BRIEF DESCRIPTION OF THE DRAWINGS

The invention will be described below, with reference to the enclosed drawings, in which.

DESCRIPTION OF THE ILLUSTRATED EMBODIMENTS

Figure 1:
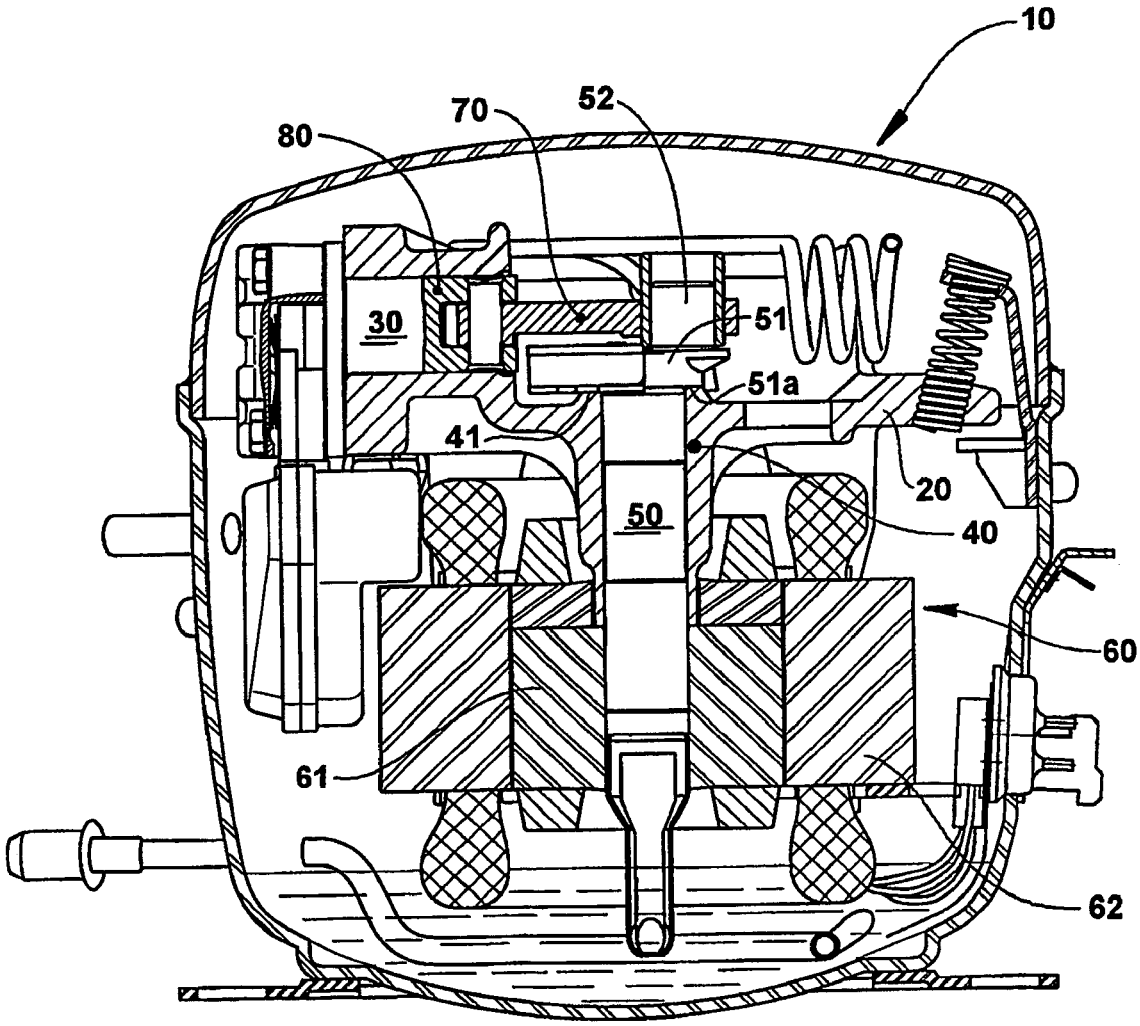
FIG.1 PRIOR ART
FIG. 1 is a median vertical sectional view of a reciprocating hermetic compressor, with a vertical crankshaft attached to the rotor of an electric motor disposed below the cylinder block and vertically supported by an axial bearing of the prior art.

FIG. 1 illustrates, in a simple way, a reciprocating hermetic compressor comprising a shell 10, inside which is appropriately suspended a cylinder block 20 defining a cylinder 30 and incorporating a vertically disposed radial bearing hub 40 bearing a vertical crankshaft 50, which has a lower end portion downwardly projecting below the radial bearing hub 40 to affix a rotor 61 of an electric motor 60, whose stator 62 is attached below the cylinder block 20. The crankshaft 50 further presents an upper end portion upwardly projecting above the radial bearing hub 40 and incorporating a peripheral flange 51, whose lower face defines a support annular surface 51*a*, and an eccentric portion 52, to which is mounted the larger eye of a connecting rod 70, whose smaller eye is mounted to a piston 80 reciprocating inside the cylinder 30.

In this type of prior art construction, the support annular surface 51*a* is supported by an upper annular face 41 of the radial bearing hub 40, so as to define an axial sliding bearing that supports the weight of the crankshaft 50-rotor 61 assembly.

Figure 2:
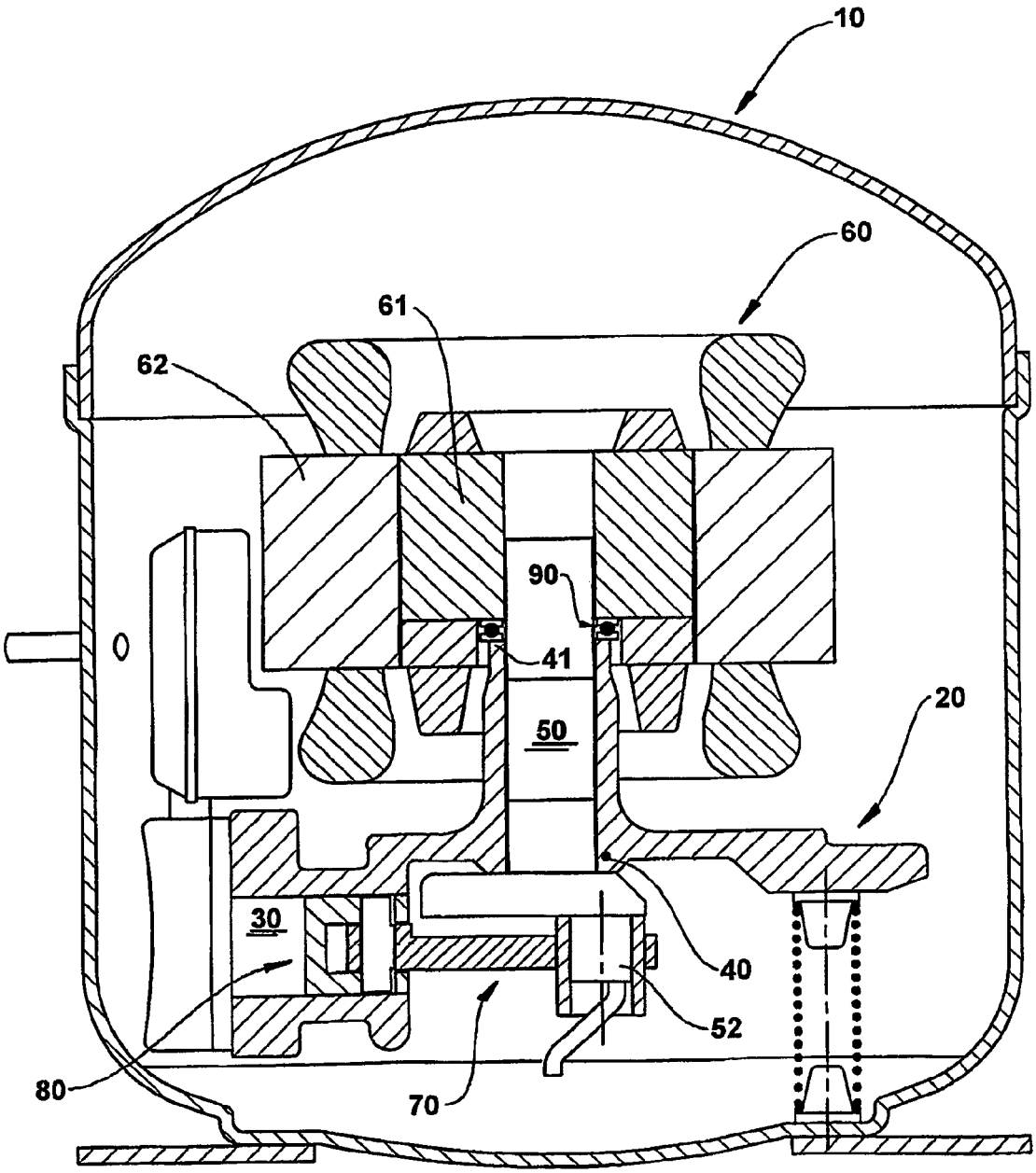
FIG.2 PRIOR ART
FIG. 2 is a similar view to that of the previous figure, but illustrating a prior art construction in which the rotor of the electric motor is positioned above the cylinder block and vertically supported by an axial rolling bearing of the prior art.

FIG. 2 also illustrates a reciprocating hermetic compressor with the same basic elements already described in relation to the compressor of FIG. 1 and which are represented by the same reference numbers. However, in the construction illustrated in FIG. 2, the electric motor 60 is provided above the cylinder block 20 and consequently above the radial bearing hub 40, allowing the axial bearing to remain positioned at a distance from the axis of cylinder 30 in which the deviations from the parallelism between the two annular surfaces of the axial bearing are relatively small.

In the construction of FIG. 2, an axial rolling bearing 90 is used, seated against the upper annular face 41 of the radial bearing hub 40 against a respective lower surface portion of the rotor 61.

Figure 3:
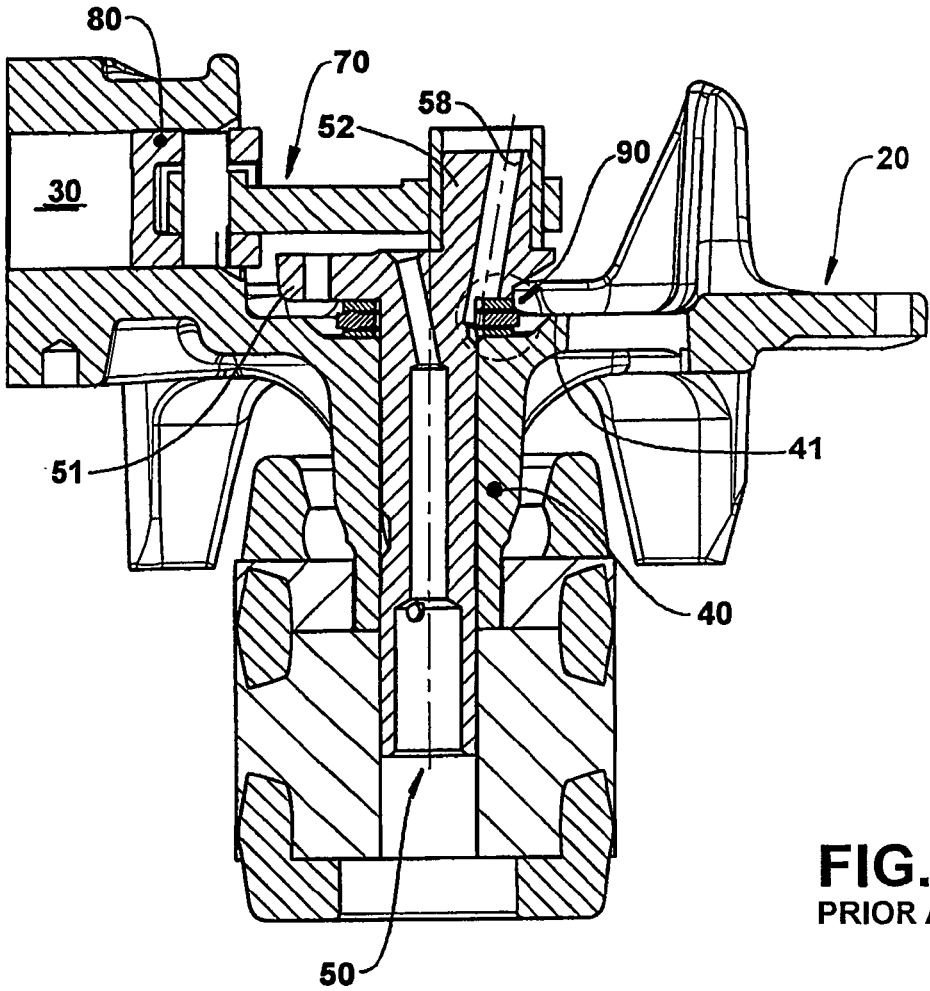
FIG.3 PRIOR ART
FIG. 3 is a partial vertical sectional view of a cylinder block of the type illustrated in FIG. 1, incorporating a vertical radial bearing hub, on which upper end is seated an axial rolling bearing for the crankshaft-electric motor rotor assembly, according to the prior art teachings.
Figure 3A:
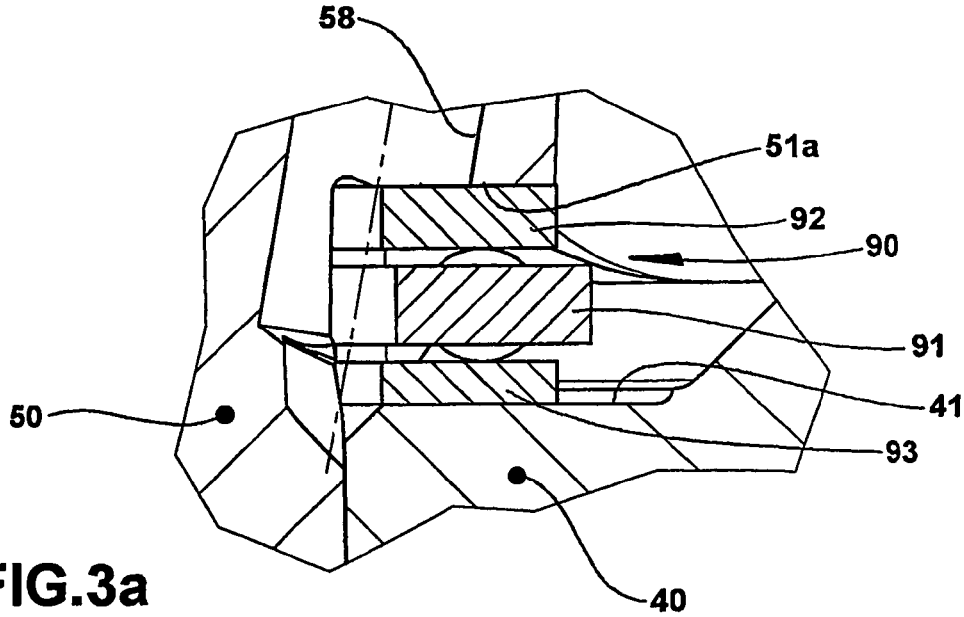
FIG.3a PRIOR ART
FIG. 3*a* shows an enlarged detail of part of FIG. 3.

In the construction of FIGS. 3–3*a*, there is illustrated an arrangement for an axial rolling bearing adapted to a reciprocating hermetic compressor, with the crankshaft 50 thereof being vertically disposed and carrying the rotor of an electric motor mounted below the cylinder block 20 and the radial bearing hub 40.

In this prior art construction, the axial rolling bearing 90 comprises a circular cage 91 containing a plurality of balls that are angularly spaced from each other and supported by an upper annular race 92 and by a lower annular race 93, in the form of flat metallic washers, which are respectively seated against the support annular surface 51*a* of the crankshaft 50 and the upper annular face 41 of the radial bearing hub 40. In order to assure the correct positioning of the extension of the crankshaft So in relation to the cylinder axis, the upper annular face 41 of the radial bearing hub 40 is recessed to a depth such as to absorb the increase of the height of the axial rolling bearing 90.

However, even not causing an alteration in the extension of the crankshaft 50, the provision of the axial rolling bearing 90 by means of this simple technique leads to an increase in the distance, between the axis of cylinder 30 and the upper annular face 41 of the radial bearing hub 40, which defines the beginning of the radial bearing.

Figure 4:
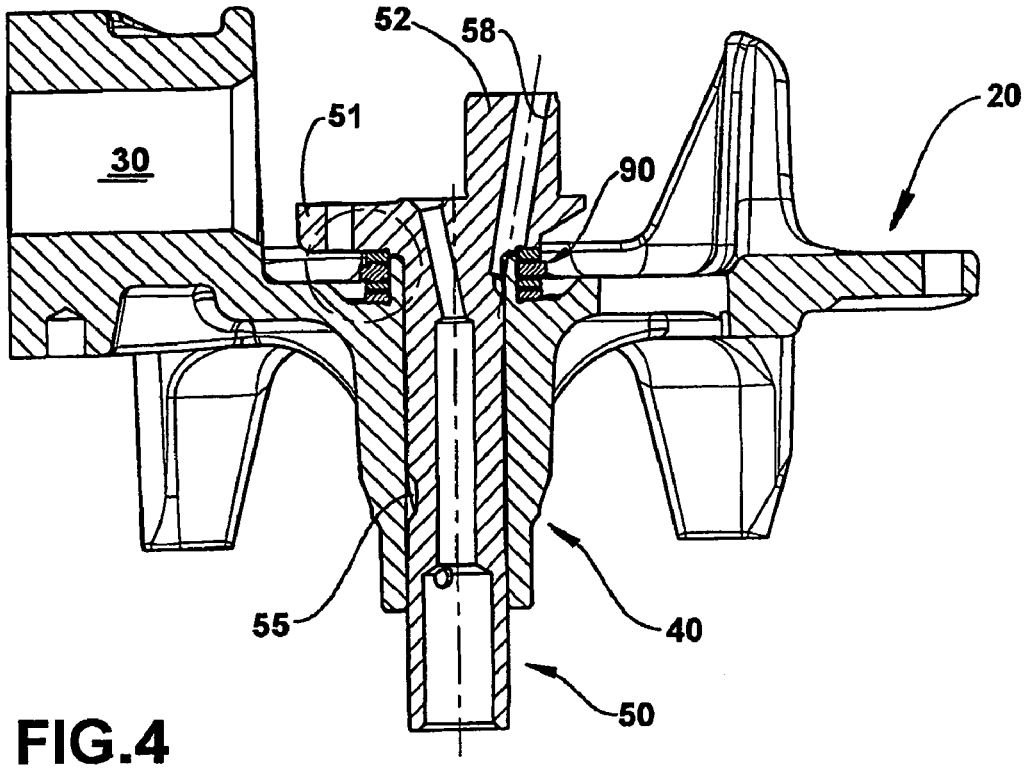
FIG. 4 is a partial vertical sectional view of a cylinder block of the type illustrated in FIG. 1 and incorporating a radial bearing hub, which has been constructed to receive an axial rolling bearing according to the arrangement of the present invention.
Figure 4A:
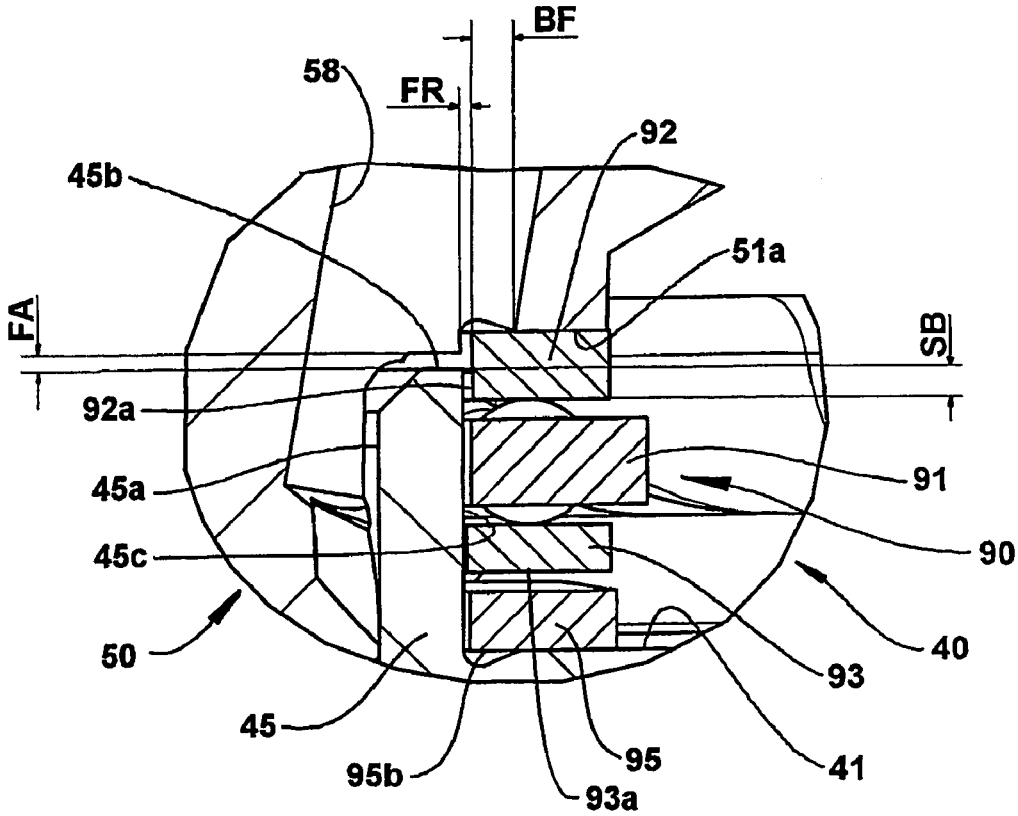
FIG. 4*a* shows, in an enlarged scale, part of FIG. 4, illustrating a first embodiment for the axial rolling bearing arrangement.

FIG. 4 illustrates, together with FIG. 4*a*, a first embodiment for the bearing arrangement of the present invention.

According to the invention, the radial bearing hub 40 incorporates an upper tubular extension 45 that has an internal face 45*a* bearing a corresponding extension of the crankshaft 50, an annular end face 45*b*, and an external face 45*c*, around which is mounted, with a certain minimum radial gap, an axial rolling bearing 90, with a more adequate construction, as compared for example with that previously described in relation to FIG. 3*a*.

As more clearly illustrated in FIG. 4*a*, the axial rolling bearing 90 has its upper annular race 92 seated against the support annular surface 51*a* of the peripheral flange 51 of the crankshaft 50 and against the upper annular face 41 of the radial bearing hub 40, which is maintained axially spaced back in relation to the annular end face 45*b* of the upper tubular extension 45. In the embodiments illustrated in FIGS. 4–4*c*, the upper annular face 41 of the radial bearing hub 40 is axially spaced back to the inside of the contour of the latter, to be able to receive the axial rolling bearing 90, without requiring substantial alterations in the design of the radial bearing hub 40.

The axial back spacing of the upper annular face 41 of the radial bearing hub 40, the height of the axial rolling bearing 90, and the dimensions of the upper tubular extension 45 are designed to guarantee the axial bearing of the crankshaft 50 will have a minimal axial gap, which can be easily achieved in terms of manufacture and mounting, between the annular end face 45*b* of the upper tubular extension 45 and the support annular surface 51*a* of the crankshaft 50.

In the constructions in which the oil pumping from the lower end to the eccentric portion 52 of the crankshaft 50 is made through the interior of the latter, the lubrication of the axial rolling bearing 90 can be made by controlled directioning of part of the oil flow conducted to the eccentric portion 52, without impairing the lubrication of the latter, even if a certain oversized gap exists between the support annular surface 51*a* of the crankshaft 50 and the annular end face 45*b* of the upper tubular extension 45 of the radial bearing hub 40.

However, in cases in which the upward pumping of the lubricant oil stored in the bottom of the shell 10 is made with the help of a helical slot 55 provided external to the crankshaft 50, special cares should be taken with the construction of the axial rolling bearing 90, in order to avoid the oil, which reaches the level of this bearing in its upward flow, from leaking radially through the region of the axial rolling bearing 90, impairing the lubrication of the eccentric portion 52.

As illustrated in FIGS. 4–4*a*, the oil is upwardly impelled along the external helical slot 55 of the crankshaft 50 until it reaches the upper end of this slot in the region of the axial rolling bearing 90, which upper end is opened to the lower end of an axial inclined oil passage 58 leading to the end face of the eccentric portion 52, with the lower portion of the oil passage 58 being axially opened in the region of the support annular surface 51*a*.

A possible solution to minimize this leakage is to control the axial gap FA between the support annular surface 51*a* of the crankshaft 50 and the annular end face 45*b* of the upper tubular extension 45 of the radial bearing hub 40. However, this solution demands close manufacturing and mounting tolerances in order to provide a gap that is sufficiently small to avoid oil leakage and at the same time to avoid the contact of the confronting surfaces moving relatively to each other.

FIGS. 4–4*a* illustrate a first solution, developed according to the invention to provide an adequate retention of the ascending oil flow as it passes by the axial rolling bearing 90, without generating mutually frictional surfaces and without requiring to comply with the tolerances that make difficult the manufacturing and mounting process of the compressor.

According to this first embodiment, the upper annular race 92 of the axial rolling bearing 90 is in the form of a washer with a rectangular cross section, whose internal cylindrical face 92 maintains a certain radial gap FR in relation to the cylindrical external face 45*c* of the upper tubular extension 45. Since these two surfaces move relatively to each other, due to the rotation of the crankshaft, the contact and consequently the wear between these surfaces should be avoided.

According to the present invention, this frictional contact between the internal cylindrical face 92*a* of the upper annular race 92 of the axial rolling bearing 90 and the external face 45*c* of the upper tubular extension 45 can be avoided by locking said upper annular race 92 against radial displacements in relation to the crankshaft 50, for example, by providing a stop element 51*b* carried by the crankshaft 50 in a position radially external to the external face 45*c* of the upper tubular extension 45.

In the illustrated embodiment, the stop element 51*b* is in the form of a recess of the crankshaft 50, radially internal and adjacent to the internal cylindrical face 92*a* of the upper annular race 92, and which is for example produced in the support annular surface 51*a* of the crankshaft 50.

Figure 4B:
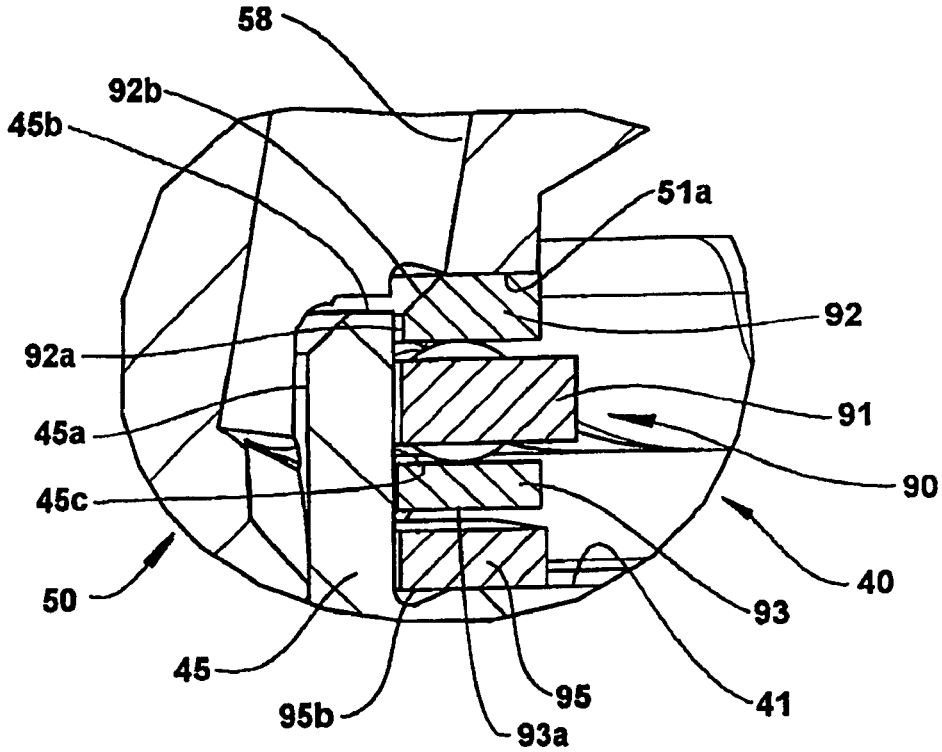
FIG. 4*b* shows, also in an enlarged scale, part of FIG. 4, illustrating a second constructive embodiment for the axial rolling bearing.
Figure 4C:
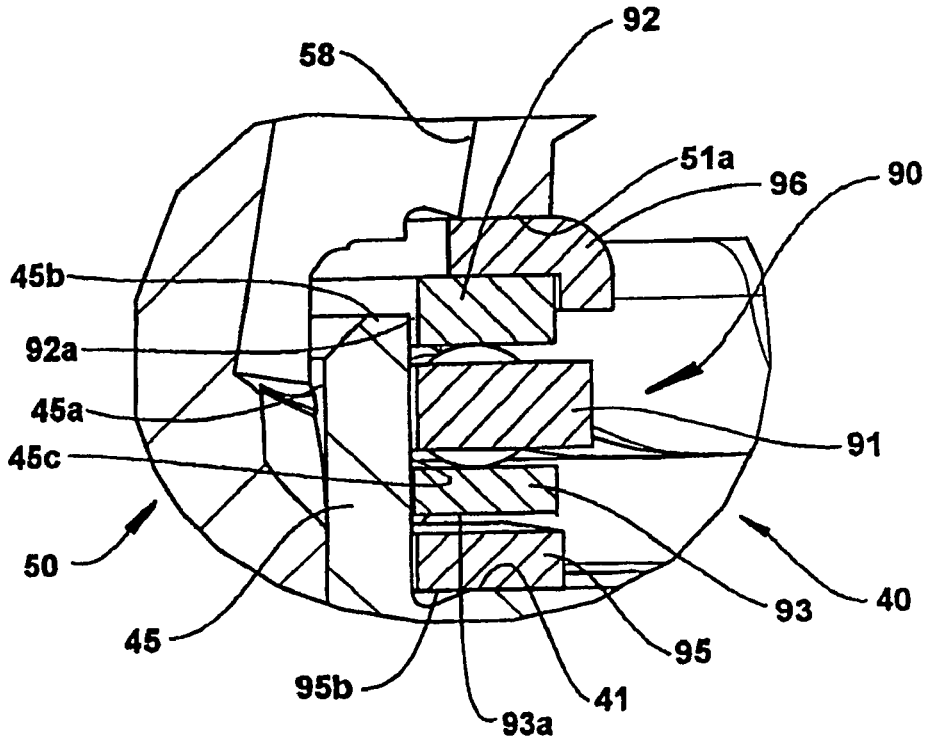
FIG. 4*c* is a similar view to that of FIGS. 4*a*–4*b*, but illustrating a third constructive embodiment for the axial rolling bearing of the present invention.
Figure 4D:
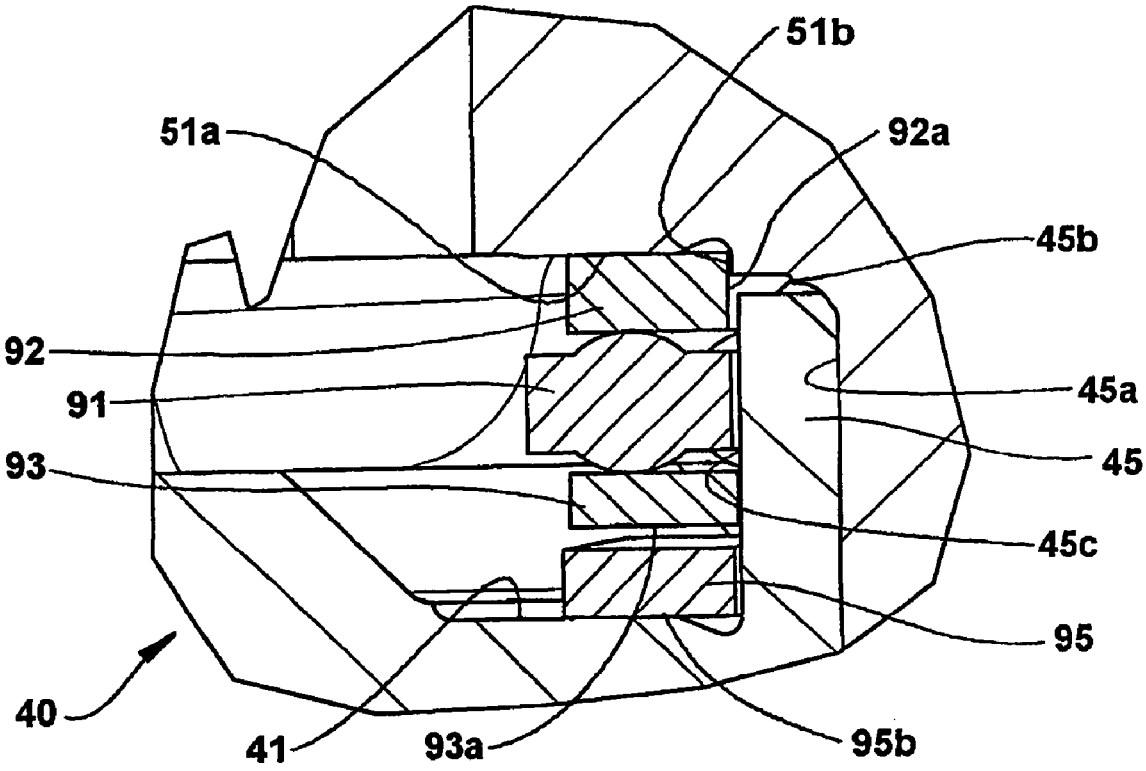
FIG. 4*d* shows, in an enlarged scale, part of FIG. 4, which is angularly offset in relation to that illustrated in FIG. 4*a* and presenting a constructive embodiment for the stop of the axial rolling bearing of the present invention.

As it can be noted in FIG. 4*d*, the internal diameter of the recess is larger than the external diameter of the external face 45*c* in the upper tubular extension 45. Although not illustrated, another form to avoid this contact can be obtained by the fixation, for example by using an adhesive element disposed between the upper annular race 92 and the support annular surface 51*a* of the crankshaft 50. In both mounting solutions described herein, the concentricity of the internal diameter of the upper annular race 92 in relation to the body of crankshaft 50 should be assured.

More or less oil retention is obtained by adjusting said radial gap FR with an axial extension with an overlapping SB of the internal cylindrical face 92*a* of the upper annular race 92 in relation to the external face 45*c* of the upper tubular extension 45, such adjustment defining a certain degree of load loss to the oil flow tending to flow downwardly between the two cylindrical confronting surfaces. Thus, the tolerance for the radial gap FR can be relaxed, facilitating the manufacture and mounting, without however allowing excess oil leakage to occur through the axial rolling bearing 90.

FIG. 4*b* illustrates a constructive variant for the solution proposed in FIG. 4*a*, according to which the upper annular race 92 in the axial rolling bearing 90 presents an inclined chamfer 92*b* at its internal upper edge, which chamfer is positioned at the level of the axial gap FA existing between the annular end face 45*b* of the upper tubular extension 45 and the support annular surface 51*a* of the crankshaft 50, in order to receive the oil flow that is radially expelled from said axial gap FA. The chamfer 92*b* operates as a force decomposition deflecting means, forcing the radial oil flow received therein to move upwardly, entering into the oil passage 58, by its radially axially opened lower portion, and being conducted up to the eccentric top. The ascending impulse obtained with the chamfer 92*b*, which may present any adequate profile, allows compensating the reduction that this configuration generally produces in the axial overlapping extension, with the radial gap FR being reduced between the upper annular race 92 and the upper tubular extension 45.

According to a constructive option of the present invention, the upper annular race 92 of the axial rolling bearing 90 comprises an upper surface portion 92*b* defining a base BF to sustain the column of lubricant oil that flows through the oil passage 58.

FIG. 4*c* illustrates a third possible construction, according to which a spacer washer 96 is provided between the upper annular race 92 of the axial rolling bearing 90 and the support annular surface 51*a* of the crankshaft 50, with the internal face 96*a* of the spacer washer 96 being maintained radially spaced from the external face 45*c* of the upper tubular extension 45, in order to define with the latter and with the upper annular race 92, an upper annular groove 100, which is opened to the axial gap FA and superiorly opened to the oil passage 58, to the interior of said groove being directed the radial oil flow impelled by the centrifugal force upon rotation of the crankshaft 50. The upper annular groove 100 presents a bottom wall that defines the base BF for sustaining the column of lubricant oil flowing through the oil passage 58.

With this disposition, the oil accumulated in the upper annular groove 100 is forced, by centrifugation, against the internal face 96*a* of the spacer washer 96. Since it is not possible for the oil to flow down due to the blocking exerted by the radial extension of the upper annular race 92 that defines the bottom of the annular groove 100, it is upwardly forced to enter inside the oil passage 58, continuing to flow up to the top of eccentric portion 52. In order to facilitate the oil rise, the annular groove 100 is entirely opened, at its upper region, to the interior of the oil passage 58, with the radially external face of the annular groove 100 being normally tangent to the contour of the oil passage 58.

Since the centrifugal force actuating over the oil in the annular groove 100 prevents said oil from radially returning toward the radial gap FR, between the upper annular race 92 and the tubular upper extension 45, this radial gap is not required to have close tolerances any more, facilitating the manufacture and the mounting of the components.

It should be understood that the provision of the spacer washer 96 represents only one exemplary form of providing an oil accumulating internal upper groove in the upper annular race 92 of the axial rolling bearing 90.

Figure 5:
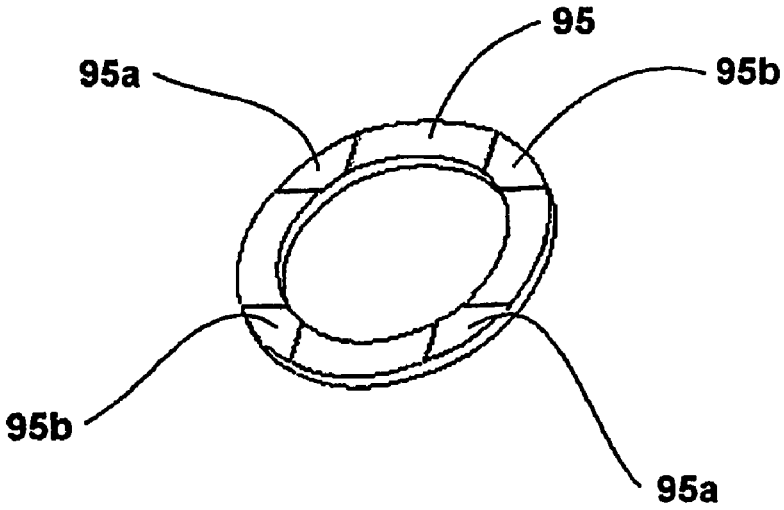
FIG. 5 is a perspective view of a support means of the present invention.

According to the illustrations of FIGS. 4–5, the arrangement of the present invention further comprises a support means 95, which is seated, by the lower portion thereof, on the upper annular face 41 of the radial bearing hub 40, and which sustains, superiorly and in a rotary fixed form, a lower face 93*a* of the lower annular race 93 in the axial rolling bearing 90, said support means 95 being constructed to be able to oscillate in relation to the upper annular face 41 of the radial bearing hub 40, and in relation to the lower annular race 93, according to diametrical axes that are mutually offset from each other in 90 degrees.

In a constructive option of the present invention, between the mutually confronting parts defined by the lower face 93*a* of the lower annular race 93 and the upper contact surface 95*a* of the support means 95, and by the lower contact surface 95*b* of the support means 95 and the upper annular face 41 of the radial bearing hub 41*a*, a respective pair of diametrically opposite convex projections are incorporated to one of said mutually confronting parts and seated against the other of said mutually confronting parts, with the alignment of one pair of convex projections being offset in 90 degrees in relation to the other pair of convex projections. Each convex projection can be, for example, in the form of a cylindrical projection incorporated to the respective part.

According to the illustrations, each of the upper contact surface 95*a* and the lower contact surface 95*b* of the support means 95 incorporates a respective pair of convex projections.

The invention claimed is:

1. An axial bearing arrangement for a reciprocating hermetic compressor comprising:

a cylinder block mounted inside a shell and carrying a cylinder and a vertically disposed radial bearing hub; and a crankshaft mounted through the radial bearing hub and having a lower end portion projecting below the radial bearing hub and affixing a rotor of an electric motor, and an upper end portion projecting above the radial bearing hub and incorporating a peripheral flange, whose lower face defines a support annular surface and an eccentric portion, wherein the radial bearing hub incorporates an upper tubular extension that has an internal face radially bearing a corresponding extension of the crankshaft, an annular end face and an external face, around which is mounted an axial roller bearing, which is simultaneously seated on the radial bearing hub and on the support annular surface of the crankshaft, in order to maintain a certain minimum axial gap between said support annular surface and the annular end face of the upper tubular extension, the axial roller bearing comprising a circular cage containing an upper annular race, having an internal cylindrical face which maintains, with the external face of the upper tubular extension, an axial extension with an overlapping, which is dimensioned to provide a desired degree of restriction to the axial oil flow through a radial gap, directing most part of said oil flow upwardly, to the interior of the oil passage internal to the crankshaft and which leads said oil to the top of an eccentric portion, said upper annular race comprising an upper surface portion defining a base for sustaining the column of lubricant oil flowing through the oil passage.

2. The axial bearing arrangement of claim 1, wherein the axial roller bearing having an upper annular race locked against radial displacements in relation to the crankshaft in order to avoid contact of its internal cylindrical face with the external face of the upper tubular extension.

3. The axial bearing arrangement of claim 2, wherein said radial locking of the upper annular race of the axial roller bearing is obtained by a stop element, which is carried by the crankshaft in a position radially external to the external face of the upper tubular extension.

4. The axial bearing arrangement of claim 3, wherein the stop element is in the form of a recess of the crankshaft, radially internal and adjacent to the internal cylindrical face of the upper annular race.

5. The axial bearing arrangement of claim 4, wherein the upper annular race of the axial roller bearing presents an inclined chamfer provided at an internal upper edge and positioned on the level of the axial gap, in order to receive therethrough the flow of the lubricant that is radially expelled from the crankshaft, directing said oil flow upwardly to the interior of oil passage.

6. The axial bearing arrangement of claim 1, wherein the upper annular race of the axial roller bearing defines an upper annular groove, in its internal region and opened to the axial gap, said groove being internally limited by the external face of the upper tubular extension and opened to the oil passage, said upper annular groove presenting a bottom wall that defines a base for sustaining the column of lubricant oil that is flowing through the oil passage.

7. The axial bearing arrangement of claim 6, wherein the radially external face of the upper annular groove is tangent to the contour of the oil passage.

8. The axial bearing arrangement of claim 7, wherein the annular groove is defined between the external face of the upper tubular extension and the internal face of a spacer washer disposed between the upper annular race and the support annular face of the crankshaft, the bottom wall of the upper annular groove being defined by the upper face of the upper annular race.

9. The axial bearing arrangement of claim 8, wherein the annular groove is limited by the external face of the upper tubular extension, by the upper surface of the upper annular race of the axial roller bearing, and by the internal face of the spacer washer, and opened to an oil passage internal to the crankshaft.

10. The axial bearing arrangement of claim 1, further comprising a support means, which is seated on the upper annular face of the radial bearing hub and which sustains, in a rotary fixed form, a lower face of the lower annular race of the axial roller bearing, said support means being constructed to be able to oscillate in relation to the upper annular face of the radial bearing hub and in relation to the lower annular race, according to diametrical axes that are mutually offset from each other in 90 degrees.

11. The axial bearing arrangement of claim 10, further comprising, between the mutually confronting parts defined by the lower face of the lower annular race and the upper contact surface of the support means, and by the lower contact surface of the support means and the upper annular face of the radial bearing hub, a respective pair of diametrically opposite convex projections being incorporated to one of said mutually confronting parts and seated against the other of said mutually confronting parts, with the alignment of one pair of convex projections being offset in 90 degrees in relation to the other pair of convex projections.

12. The axial bearing arrangement of claim 11, wherein each convex projection is a cylindrical projection incorporated to the respective part.

13. The axial bearing arrangement of claim 12, wherein each of the upper contact surface and the lower contact surface of the support means incorporates a respective pair of convex projections.

14. The axial bearing arrangement of claim 1, wherein the upper annular race and the lower annular race are each in the form of a flat washer.

15. The axial bearing arrangement of claim 1, wherein said axial roller bearing comprising a circular cage containing a plurality of balls that are angularly spaced from each other and supported on an upper annular race, having an internal cylindrical face which maintains, with the external face of the upper tubular extension, an axial extension with an overlapping, which is dimensioned to provide a desired degree of restriction to the axial oil flow through said radial gap, directing most part of said oil flow upwardly, to the interior of the oil passage internal to the crankshaft and which leads said oil to the top of an eccentric portion.

16. The axial bearing arrangement of claim 1, wherein the circular cage contains a plurality of balls that are angularly spaced from each other and supported on the upper annular race.

17. An axial bearing arrangement for a reciprocating hermetic compressor comprising:

a cylinder block mounted inside a shell and carrying a cylinder and a vertically disposed radial bearing hub; and a crankshaft mounted through the radial bearing hub and having a lower end portion projecting below the radial bearing hub and affixing a rotor of an electric motor, and an upper end portion projecting above the radial bearing hub and incorporating a peripheral flange, whose lower face defines a support annular surface and an eccentric portion, wherein the radial bearing hub incorporates an upper tubular extension that has an internal face radially bearing a corresponding extension of the crankshaft, an annular end face and an external face, around which is mounted an axial roller bearing, which is simultaneously seated on the radial bearing hub and on the support annular surface of the crankshaft, in order to maintain a certain minimum axial gap between said support annular surface and the annular end face of the upper tubular extension, the axial roller bearing comprising a circular cage containing a plurality of balls that are angularly spaced from each other and supported on an upper annular race, having an internal cylindrical face which maintains, with the external face of the upper tubular extension, an axial extension with an overlapping, which is dimensioned to provide a desired degree of restriction to the axial oil flow through a radial gap, directing most part of said oil flow upwardly, to the interior of the oil passage internal to the crankshaft and which leads said oil to the top of an eccentric portion.

* * * * *